US006478200B1

(12) United States Patent
Davis

(10) Patent No.: US 6,478,200 B1
(45) Date of Patent: Nov. 12, 2002

(54) BEVERAGE DISPENSE DEVICE

(75) Inventor: Terrence Robert Davis, Worcestershire (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/711,215

(22) Filed: Nov. 9, 2000

(30) Foreign Application Priority Data

Nov. 16, 1999 (GB) ..... 9927061

(51) Int. Cl.[7] ..... B67D 5/06

(52) U.S. Cl. ..... 222/504; 222/547; 137/170.1; 251/122

(58) Field of Search ..... 222/146.6, 504, 222/547, 564; 251/120, 121, 122; 137/601.18, 601.19, 170.1, 12.5; 138/43, 46

(56) References Cited

U.S. PATENT DOCUMENTS 585,165 A * 6/1897 Stahl ..... 215/5
4,748,998 A * 6/1988 Färber et al. ..... 137/170.1
4,979,639 A * 12/1990 Hoover et al. ..... 222/1
5,433,348 A * 7/1995 Deering et al. ..... 222/129.1
5,456,387 A * 10/1995 Trewhella ..... 222/146.6
5,634,343 A * 6/1997 Baker, III ..... 222/146.6
5,816,456 A * 10/1998 Graffin ..... 222/559
5,950,866 A * 9/1999 Lancaster ..... 222/1
5,957,343 A * 9/1999 Cavallaro ..... 222/434
6,056,155 A * 5/2000 Byerly et al. ..... 222/1
6,189,745 B1 * 2/2001 Frank ..... 222/509

FOREIGN PATENT DOCUMENTS

GB 2218357 A * 5/1988 ..... B05B/1/34

* cited by examiner

*Primary Examiner*—Lesley D. Morris
*Assistant Examiner*—Patrick Buechner
(74) *Attorney, Agent, or Firm*—Sten Erik Hakanson

(57) ABSTRACT

A beverage dispense device is designed to dispense a chilled carbonated beverage at a temperature close to the freezing point of the beverage without freezing and without excess break out of carbon dioxide. The beverage dispense device comprises a nozzle (19), a valve comprising a valve seat (13) and a closure member (16, 17), the valve being opened and closed by movement of the closure member (16, 17) out of and into contact with the valve seat (13) to allow or prevent flow of the beverage through the nozzle (19), and a flow regulator (18) between the valve seat (13) and the nozzle (19), the flow regulator (18) being adjustable to control flow rate through the nozzle (19) and being in the form of a core member (18) moveable in a flow passageway (15) downstream of the valve seat (13) and spaced from the valve seat, the core member (18) and the flow passageway (15) having matching tapering surfaces.

1 Claim, 1 Drawing Sheet

BEVERAGE DISPENSE DEVICE

FIELD OF THE INVENTION

The present invention relates generally to a beverage dispense device. It is particularly concerned with a device for the dispense of a chilled beverage, for example a chilled beer or lager, and will for convenience below be more specifically described with reference to beer or lager.

BACKGROUND OF THE INVENTION

Conventionally, beers and lagers may be chilled before being served at a dispense nozzle or spout. The cooling systems used typically have a bulk beverage supply located at a separate location from the bar counter, such as a cellar room or walk-in cooler. The beverage is chilled in the cellar by being passed through an ice bank cooler to a temperature just below its ultimate dispense temperature. The chilled beverage is then pumped from the cellar room to the bar within an insulated python.

If one wishes to dispense a carbonated beverage at very cold temperatures e.g. below 0° C., increased problems of carbon dioxide break out can occur. When the dispense tap is opened, there is inevitably a pressure drop in the beverage being dispensed so that some of the carbon dioxide dissolved in the beverage comes out of solution. The colder the beverage is at the dispense point the greater the potential for carbon dioxide breakout and it is quite possible that the foaming that this causes renders impossible the presentation to the customer of a satisfactory glass of beer or lager, for example. Moreover, there is also a greater risk of the beverage freezing during the dispense because of the carbon dioxide break out.

It is, therefore, an object of the present invention to provide a dispense device which is capable of successfully dispensing a chilled carbonated beverage at lower temperatures than have conventionally been used, e.g. at a temperature close to the freezing point of the beverage, without freezing and without excessive break out of carbon dioxide.

SUMMARY OF THE INVENTION

Accordingly, the present invention provides a beverage dispense device comprising, a nozzle, a valve comprising a valve seat and a closure member, the valve being opened and closed by movement of the closure member out of and into contact with the valve seat to allow or prevent flow of the beverage through the nozzle, and a flow regulator between the valve seat and the nozzle, the flow regulator being adjustable to control flow rate through the nozzle and being in the form of a core member movable in a flow passageway downstream of the valve seat and spaced from the valve seat, the core member and flow passageway having matching tapering surfaces.

The flow regulator downstream of the valve effectively provides a back pressure to the beverage being dispensed and thereby provides an adjustable pressure drop to which the beverage is subjected when the valve is opened. This adjustment can be finely tuned to optimise the dispense conditions for any particular beverage. Preferably the valve is an electrically-operated valve and is preferably a solenoid valve but it may be, for example, a stepper motor controlled valve. Preferably the device has a flow channel for the beverage on the downstream side of the valve seat, which channel widens, i.e. increases in area, as it gets further from the valve seat and nearer to the exit point from the dispense nozzle. The flow regulator, comprising a core of tapering exterior surface which taper matches that of a tapering flow passageway on the downstream side of the valve seat, preferably tapers so as to narrow towards the valve seat. The flow channel is then defined by the gap between the core and the wall of the flow passageway. The core sits movably in the passageway so that when the valve is opened flow takes place through a gradually widening annular channel defined between the surface of the core and the interior wall of the passageway. The position of the core is adjustable, i.e. it can be moved nearer to or further from the valve seat, as circumstances require, whereby flow rate through the nozzle when the valve is opened may be decreased or increased. Thus, the pressure drop to which the beverage is subjected on dispense through the nozzle can be adjusted as required according to the nature of the beverage, its temperature and its degree of carbonation.

The core may be integrally formed with or otherwise attached to means to adjust its position relative to the valve seat. In a particularly convenient embodiment the core is formed integrally with the spout, i.e. nozzle. The means to adjust the core position may be any convenient means. For example, screw-threaded means may be mounted on the integral spout and rotated to make the required adjustment. In an alternative embodiment the adjustment may be by means of a stepper motor, for example. Where a stepper motor is used for this purpose it may have the dual function of also opening and closing the valve.

The invention herein enables beers, lagers and other carbonated beverages to be dispensed at lower temperatures than would otherwise be possible without excessive carbon dioxide break out and risk of freezing. Thus, by way of example only, the dispense device of the invention is particularly useful for the serving of beers or lagers at temperatures below 0° C., e.g. as low as −4° or −5° C. The device of the invention enables the dispensing system to maintain sufficient back pressure to prevent these break out and freezing problems.

DESCRIPTION OF THE DRAWINGS

A better understanding of the structure, function, operation and the objects and advantages of the present invention can be had by reference to the following detailed description which refers to the following figure, wherein.

DETAILED DESCRIPTION OF THE PREFERRED EMBODIMENT

Figure 1:
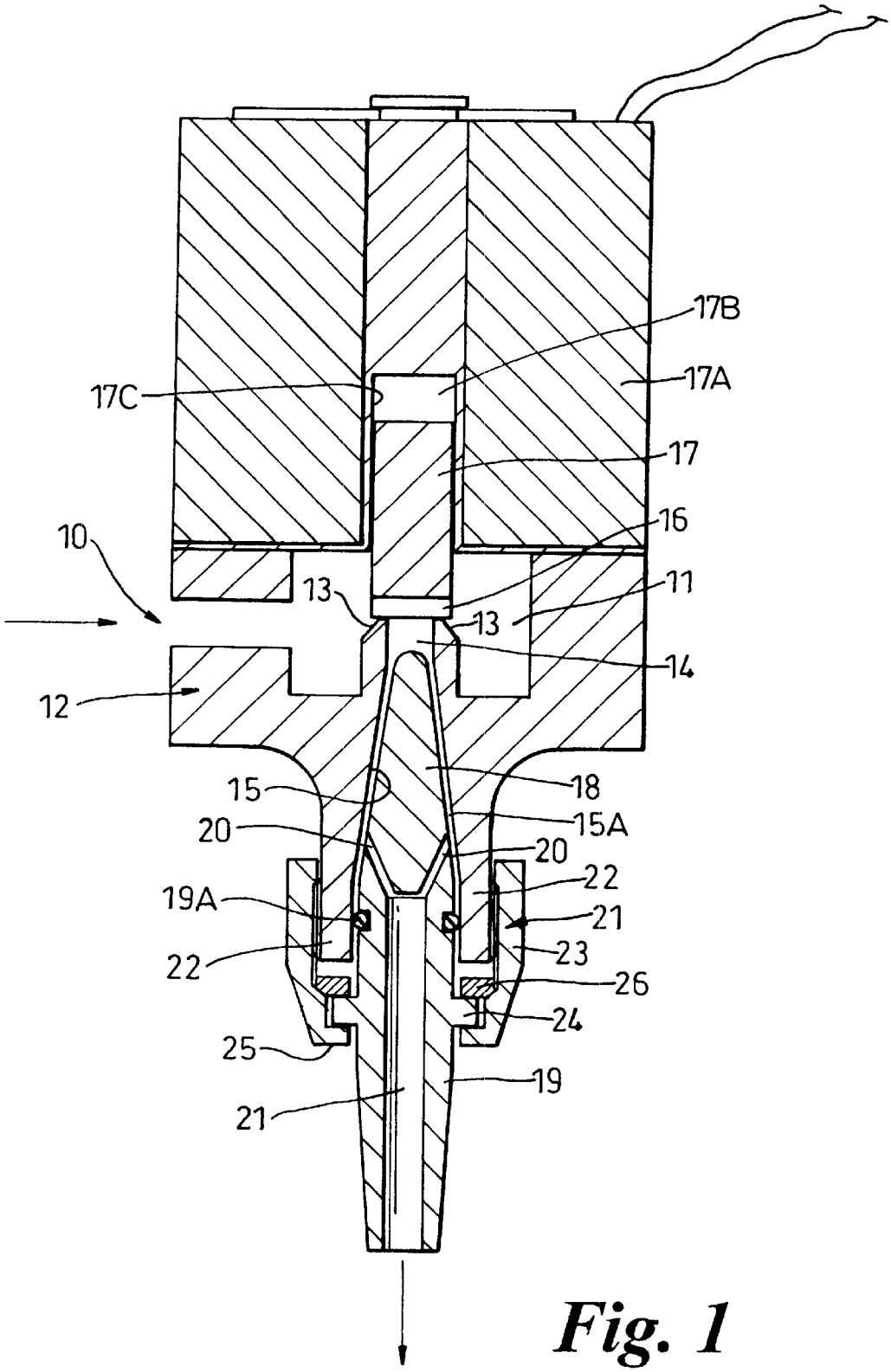
FIG. 1 shows a cross-sectional view of one form of dispense device of the present invention.

The present invention will now be described by way of example only with reference to FIG. 1, which is a cross-sectional view of one form of dispense device containing a solenoid valve. The device of the invention has an inlet 10 defined in body 12 and which leads to a cavity 11 inside the body. Inlet 10 can be connected to a remote source of beverage, e.g. a keg of beer in a cellar. A valve seat 13 is defined within the cavity 11 and leads via a port 14 to a generally conically-shaped flow passageway 15.

In the valve-closed position a seal 16 carried on the lower end of an armature 17 sits on seat 13 and closes port 14 from cavity 11. When the solenoid valve is actuated, armature 17 between the energised coils 17A rises in the recess 17B in its housing 17C. It carries seal 16 with it, thereby opening the valve to allow flow through port 14 and into channel 15A, which is defined between the exterior surface of a conical core 18 fitted into the conical passageway 15 in the body 12 and the passageway walls. Core 18 is formed as an integral unit with a hollow spout or nozzle 19. Ports 20 through the wall thickness of the unit adjacent its junction between core and spout allow beverage to flow from channel 15A to the tubular outlet 21 defined through spout 19 and thereby be dispensed into, e.g. a glass. Flow of beverage through the device is indicated by the arrows.

The spout 19 is movable up and down within an externally threaded annular extension 22 which depends downwardly of body 12. Thus the flow regulator, comprising extension spout 19 and core 18, extends through extension 22 into the passageway 15, thereby defining channel 15A. An adjusting screw ring 23 is threaded onto extension 22 and ring 23 is secured to spout 19. This securement is achieved by capturing an annular rib 24 on the exterior surface of the spout between a lower inwardly depending flange 25 and a locking ring 26 on ring 23. Spout 19 sealingly engages the inner wall of extension 22 by means of an annular seal 19A which is held in a corresponding groove in the surface of the spout.

The position of core 18 relative to valve seat 13 can, therefore, be adjusted upwardly or downwardly by appropriate rotation of adjusting screw ring 23. This increases or decreases the size of flow channel 15A to control the pressure drop experienced by the beverage when the valve is opened. Thus the core/spout unitary flow regulator can be positioned according to the nature of the drink to be dispensed in order to minimise carbon dioxide breakout and risk of freezing of beverages cooled below 0° C.

Ports 20 may preferably have the same total cross-sectional area as that of spout 19 to further assist prevention of gas breakout. It will be appreciated that the invention is not limited to the embodiments shown. As indicated above, the adjustment to the flow regulator may be made in stepped sequence rather than by continuously variable adjustment by screw-thread. The adjustment means may, for example, be a stepper motor and the valve seat may be achieved by direct contact between the core and the wall of the flow passageway. The valve may be a multi-port recirculating valve so that the beverage can be recirculated through a cooler between dispenses so that it does not stand and begin to warm up before being dispensed. Although the conical flow regulator core is preferably of increasing circular transverse cross-section in the direction from the valve to the nozzle, it will be appreciated that other cross-sections may be utilised, if desired, e.g. elliptical or triangular.

What is claimed is:

1. A beverage dispensing valve, comprising:

a valve body having a beverage inlet in fluid communication with a flow cavity within the valve body, a valve seat within the flow cavity in fluid communication with a port leading directly to a flow passageway, the flow passageway being generally conical in shape and increasing in diameter in a downstream direction from the seat to a distal end thereof and defining an internal conical flow passageway flow surface, a flow regulator having a conical end portion and an opposite nozzle end portion, the conical portion being retained within the flow passageway and leaving an external conical flow surface generally complimentary in shape to that of the internal conical flow passageway flow surface and the flow regulator positioned so that there exists a conical flow passageway between the internal conical flow surface of the flow passageway and the external conical flow surface of the flow regulator, and the flow regulator nozzle end extending externally of the flow passageway and having a central flow passageway in fluid communication with the conical flow passageway, sealing means for fluid tight sealing of the flow regulator conical portion within the flow passageway, an adjustment means including a ring threadably secured around a spout portion of the valve body out of which spout portion the nozzle end portion of the flow regulator extends, the ring cooperating with a flange of the nozzle end portion of the flow regulator for setting the position of the flow regulator for adjusting the amount of separation between the internal conical flow surface of the flow passageway and the external conical flow surface of the flow regulator for regulating the flow rate of beverage through the conical flow passageway so that said flow rate can be adjusted manually without contact with the beverage or with surfaces that come into contact with the beverage either during a dispensing of the beverage or between dispensings thereof, and a linear drive means for operating a closure member having a distal end extending into the flow cavity, the closure member distal end having a seal thereon for cooperating with the seat for regulating beverage flow from the flow cavity into the flow passageway.

* * * * *